United States Patent [19]

Williams

[11] 4,258,492

[45] Mar. 31, 1981

[54] SIGN HOLDER FOR VEHICLE

[76] Inventor: Harry G. Williams, 502 LaPorte Ave., South Bend, Ind. 46628

[21] Appl. No.: 36,079

[22] Filed: May 4, 1979

[51] Int. Cl.[3] ..... G09F 7/20; G09F 21/04

[52] U.S. Cl. ..... 40/593; 40/591

[58] Field of Search ..... 40/591, 593, 592, 610, 40/606, 607

[56] References Cited

U.S. PATENT DOCUMENTS

| | | | |
|---|---|---|---|
| 2,780,880 | 2/1957 | Snider | 40/591 |
| 2,902,241 | 9/1959 | Spitko | 40/591 X |
| 3,004,359 | 10/1961 | Pisciotta | 40/591 |

FOREIGN PATENT DOCUMENTS

| | | | |
|---|---|---|---|
| 2506493 | 8/1976 | Fed. Rep. of Germany | 40/593 |

*Primary Examiner*—John F. Pitrelli

*Attorney, Agent, or Firm*—Marmaduke A. Hobbs

[57] ABSTRACT

A sign holder for a window of a vehicle, such as a station wagon, car or pick-up truck, in which a panel for displaying a sign is supported by one or more fixtures, each of the fixtures having a tubular member normally extending vertically at the rear of said panel and having reciprocable shafts extending out of the upper and lower ends. The shafts are provided with shoes which seat on the frame of the window, and the panel is held in spaced relation to the window to permit circulation of air and thus minimize condensation on the window and face of the sign. A spring or other resilient member is disposed between the shafts for urging the shafts upwardly and downwardly to seat the shoes on their respective window frame members.

8 Claims, 5 Drawing Figures

SIGN HOLDER FOR VEHICLE

People engaged in small businesses often use their personal or family cars part time in the business, and at other times use the cars strictly for personal or family use. Under these circumstances it is usually undesirable to use permanent business signs on the sides of the car, since they detract from the appearance of the car, making it less desirable for personal or family use. Plastic signs with magnets for securing the signs to the sides of the car have been extensively used and do permit the cars to be used in the business with the signs, and for personal and family use without the signs. This magnetic type of sign, however, has several inherent disadvantages, including damage to the finish on the car and easy removal by vandals and other unauthorized persons. It is therefore one of the principal objects of the present invention to provide a sign holder for a vehicle such as an automobile or pick-up truck, which can be easily and quickly inserted in a side or rear window frame on the inside of the glass, and which can be easily removed from the window whenever use of the sign is not desired.

Another object of the invention is to provide a sign holder for a car window which is secured firmly in place by yieldable fixtures engaging the window frame, without marring or otherwise damaging the finish on the frame, and which is simple in construction and operation and can be inserted in position and removed therefrom without the use of any tools, special equipment or separate accessories.

Still another object of the invention is to provide a sign holder for cars and similar vehicles, which automatically will fit windows of different sizes without the necessity of making adjustments in the fixtures, and which can easily be adapted to hold signs of various types and shapes either of a temporary or permanent nature, and, when mounted in the car window, does not interfere with opening and closing the window.

A further object is to provide a sign holder of the afore-mentioned type which can be constructed of a variety of different materials, including plastic or metal, and which utilizes spring operated securing fixtures adapted for use, either alone or in combination, on different sized sign holders.

Additional objects and advantages of the invention will become apparent from the following description and accompanying drawings, wherein.

Referring more specifically to the drawings, numeral 10 indicates generally a station wagon, with the present sign holder 12 on the inside of the rear side window 14. While the rear window of the station wagon in which the sign is mounted often cannot be opened or closed, the sign is equally adaptable and usable in windows which can be opened by lowering the glass window, and the sign can be used satisfactorily with the window either closed or opened. While the sign is mounted in a window of a station wagon, it is readily adaptable to the windows of other types of automotive vehicles, including cars, pick-up trucks, vans and buses.

Figure 1:
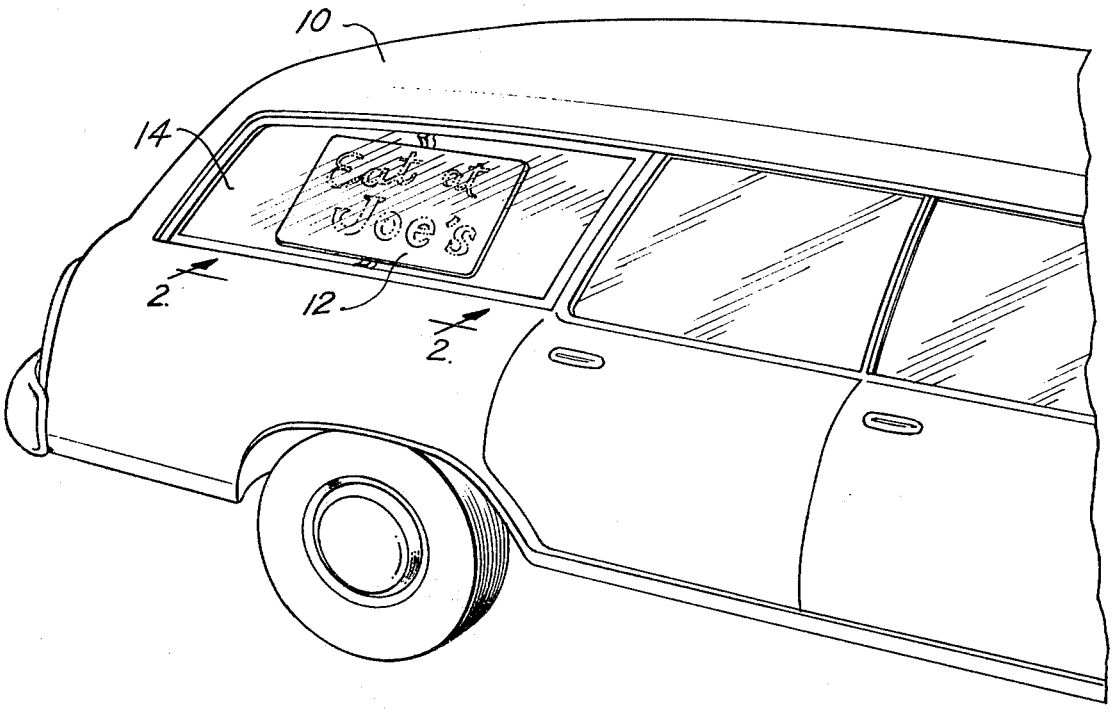
FIG. 1 is a fragmentary perspective view of a station wagon with the present sign holder inserted in one of the rear side windows.
Figure 2:
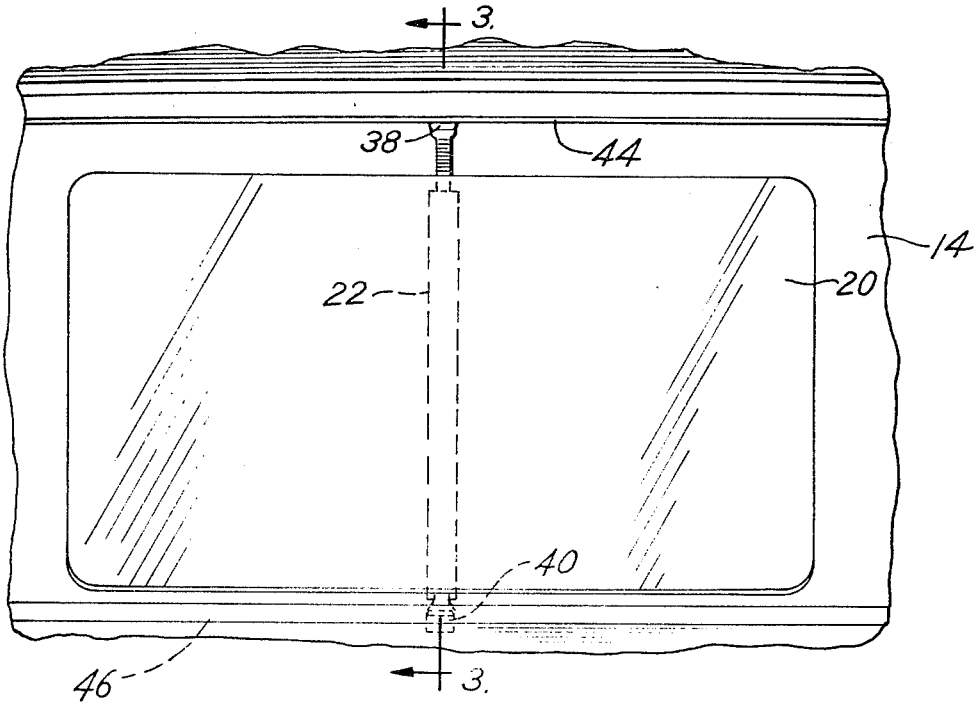
FIG. 2 is an enlarged, fragmentary side elevational view of the vehicle shown in FIG. 1, illustrating the sign holder in greater detail.

The sign holder illustrated in FIG. 2 consists of a rectangular panel 20 of pressed wood, plastic or metal of rigid construction, and preferably sufficiently firm that no frame or other reinforcing members are required to maintain it in its flat form. The panel is smaller, or at least no larger, than the window in which it is to be placed.

A fixture 22 is firmly secured to the rear side of the panel by any suitable securing means such as screws, bolts or an adhesive. In the event the panel is galvanized sheet metal, copper or the like, and the fixture is of similar metal, the fixture may be secured to the panel by soldering or brazing at points 24 along the length of the fixture.

Figure 3:
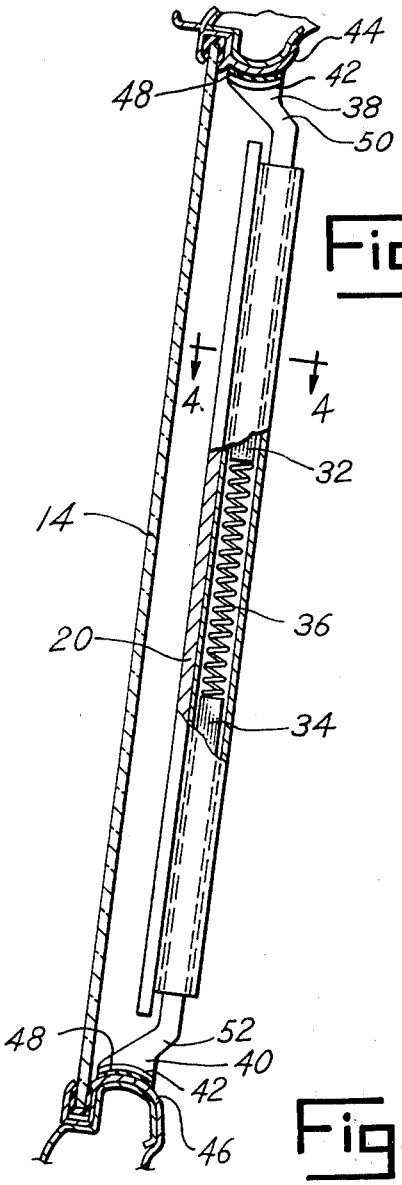
FIG. 3 is a vertical cross sectional view through the sign holder and a portion of the vehicle, the section being taken on line 3—3 of FIG. 2.
Figure 4:
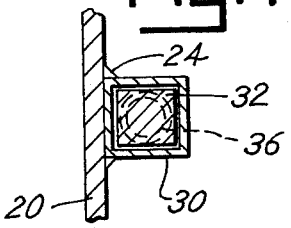
FIG. 4 is a horizontal cross sectional view of a portion of the sign holder, the section being taken on line 4—4 of FIG. 3.

The fixture consists of a tubular body 30, preferably square in cross sectional shape and constructed of metal, and contains upper and lower shafts 32 and 34 urged toward the respective ends by a coil spring 36 reacting between the inner ends of the two shafts, as best illustrated in FIG. 3. The two shafts can easily be moved inwardly and outwardly in their respective ends and are constantly urged outwardly by the spring. Mounted on the upper and lower ends of shafts 32 and 34, respectively, are shoes 38 and 40 which are rigidly secured to the respective shafts, and each is provided with a foot 42 which seats on the molding 44 and 46 along the window at the upper and lower portions thereof. The feet are preferably arcuate in shape to conform generally to the curved shape of the car molding on which they seat, and contain a pad 48 of rubber, plastic or other suitable relatively soft material which will prevent slipping of the shoe and marring of the finish of the molding by the shoe.

While it is desirable to have the front of panel 20 reasonably close to the inner side of the glass 14, it is also desirable to have it spaced therefrom so that air can circulate between the glass and the panel or the sign thereon, so that moisture and frost will not accumulate on the glass and diminish the visiblilty of the sign. In order to accomplish this, the two shoes are connected to the ends of the shafts by forwardly and angularly extending sections 50 and 52 joined rigidly to the shoes and holding the panel away from the window.

In the use of the present sign holder, a sign is either painted on the front surface of the panel, or a separate sign, such as a poster, may be secured by tape or any other suitable securing means to the front side of the panel. The holder is then inserted in the window between the upper and lower frames by placing either foot 42 on the respective window frame and pressing the shafts inwardly into tubular body 30 so that the other foot can be seated on the opposite frame. When the feet are released, spring 36 automatically seats the two feet firmly on the frames by pressing outwardly on the ends of shafts 32 and 34. The square relationship of the two shafts and the tube prevents the shoes from turning when only one fixture is used, and assists in holding the sign in its proper position parallel to the surface of the glass window. The sign holder will remain firmly in place until it is intentionally removed by pressing shaft 32 downwardly or shaft 34 upwardly to unseat the respective foot and thereby permit the end of the fixture, and hence the sign, to swing inwardly so that it can be lifted from between the upper and lower window frames.

In view of the easy manner in which the sign can be mounted in and removed from the inside of the car window, the sign can be inserted when the car is to be used for business and removed therefrom when the car is to be used for personal or family use. The sign and sign holder likewise can be easily transferred from one automobile window to another without any adjustments being required other than compressing the shafts inwardly and releasing them when the sign holder is mounted in place at the window and removed therefrom. Further, the sign is mounted inside the vehicle where it is protected from the weather, road slush and the like.

Figure 5:
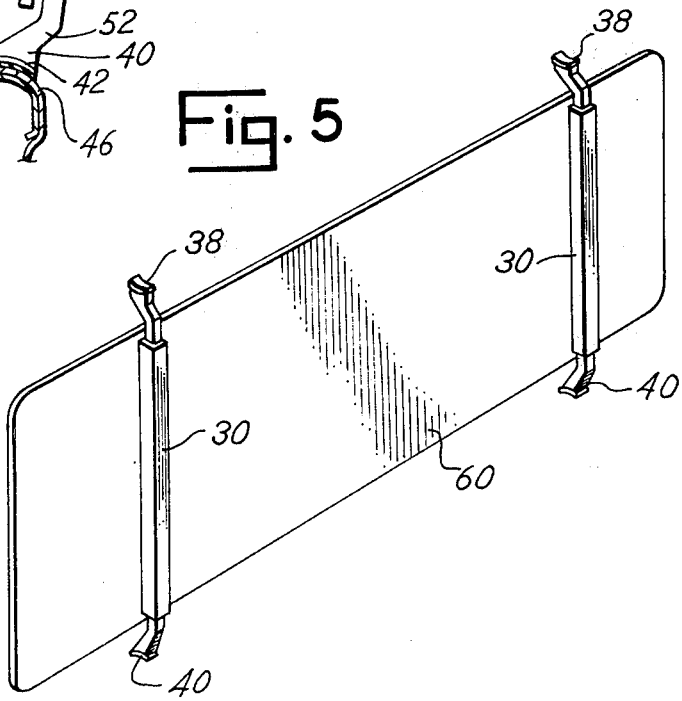
FIG. 5 is a rear perspective view of a somewhat larger sign holder than those shown in the preceding figures, but having basically the same structure.

The embodiment of the invention illustrated in FIG. 5 is essentially the same as that illustrated in the preceding figures with the exception that in FIG. 5 the sign panel 60 is somewhat longer than the sign panel 20, and two fixtures 30 are used near the ends of the panel rather than a single fixture near the middle as in the previously described embodiment. The fixtures are secured to the signs in any suitable manner, as previously mentioned, and the sign holder is mounted in place at the car window by depressing the shafts of both fixtures simultaneously to permit the feet to be seated on the upper and lower moldings at the window. The fixtures used in the embodiment of FIG. 5 are essentially identical to the fixtures of the previously described embodiment, and hence like numerals are used to identify like parts. The fixtures are shown in vertical position in the drawings; however, it may be possible to mount the sign in the window using the fixtures positioned horizontally, provided the vertical molding along each side of the window is adapted to receive the opposite feet of the fixture or fixtures.

While only two embodiments of the present sign holder invention have been described in detail herein, various changes and modifications may be made without departing from the scope of the invention.

I claim:

1. A sign holder for a vehicle window having opposed frame members along the inside of the glass, comprising a sign display panel for mounting on the inside of the window, a fixture connected to the rear side of the panel and having reciprocable shafts extending beyond opposite edges of the panel, a resilient means urging at least one of said shafts toward the respective panel edge, and a shoe disposed at substantially a right angle to the plane of the front of said panel on the outer end of each of said shafts and having a curved, smooth frame engaging surface thereon for seating on the window frame member, said shoe extending forwardly beyond the front surface of the panel for spacing the front surface of said panel from the surface of the window glass.

2. A sign holder for a vehicle window as defined in claim 1 in which said fixture includes a tubular member in which said shafts are disposed and from which said shafts extend, and said resilient member is disposed in said tubular member and reacts against the inner ends of said shafts.

3. A sign holder for a vehicle window as defined in claim 2 in which said resilient means consists of a coil spring.

4. A sign holder for a vehicle window as defined in claim 1 in which said shoe has a recess in the surface which engages the window frame member to assist in holding the sign in place at the window.

5. A sign holder for a vehicle window as defined in claim 3 in which said shoe has a recess in the surface which engages the window frame member to assist in holding the sign in place at the window.

6. A sign holder for a vehicle window as defined in claim 1 in which two fixtures of the type defined are mounted parallel to one another on the rear side of said panel and are spaced from one another thereon.

7. A sign holder for a vehicle window as defined in claim 5 in which two fixtures of the type defined are mounted parallel to one another on the rear side of said panel and are spaced from one another thereon.

8. A sign holder for a vehicle window as defined in claim 2 in which said tubular member and said shafts are square in cross sectional shape and said tubular member is connected to said panel.

* * * * *